United States Patent [19]

Tseng et al.

[11] Patent Number: 5,069,630

[45] Date of Patent: Dec. 3, 1991

[54] SOCKET ASSEMBLY FOR ELECTRICAL PLUGS

[76] Inventors: Jeou N. Tseng; Chen S. Hong; Jeng S. Wu, all of No. 15, Lane 167, Tung Nan Street, Hsinchu City, Taiwan

[21] Appl. No.: 591,270

[22] Filed: Oct. 1, 1990

[51] Int. Cl.[5] ..... H01R 13/44

[52] U.S. Cl. ..... 439/137; 439/145

[58] Field of Search ..... 439/131, 135–137, 439/141–145, 147, 149, 347; 174/66, 67

[56] References Cited

U.S. PATENT DOCUMENTS

| | | | |
|---|---|---|---|
| 3,601,758 | 8/1971 | Davidsson | 439/137 |
| 3,986,763 | 10/1976 | Sparrow | 439/137 |
| 4,072,382 | 2/1978 | Reschke | 439/143 |
| 4,094,569 | 6/1978 | Dietz | 439/145 X |
| 4,379,607 | 4/1983 | Bowden, Jr. | 439/137 |
| 4,722,693 | 2/1988 | Rose | 439/137 |
| 4,952,755 | 8/1990 | Engel et al. | 439/145 X |

FOREIGN PATENT DOCUMENTS

| | | | |
|---|---|---|---|
| 0033411 | 8/1981 | European Pat. Off. | 439/137 |

*Primary Examiner*—Neil Abrams
*Assistant Examiner*—Khiem Nguyen
*Attorney, Agent, or Firm*—Bacon & Thomas

[57] ABSTRACT

A socket assembly comprising a number of sliding plates spaced from one another and arranged in a row between a base and a cover fixedly mounted to the base. Each sliding plate has a pair of slots thereon which is operable by an insertion of an ordinary plug to move the sliding plate directly in a lateral direction perpendicular to the row alignment. The sliding plate is able to return to an original position where communication between the slots on the cover and the channels on the base is blocked. Various types of springs are mountable on the cover, the sliding plate, or an additional securing plate disposed between the base and the sliding plate, or to be integral to the sliding plate. In a further embodiment, the pair of slots on each sliding plate is operable to move separately and independently.

3 Claims, 6 Drawing Sheets

SOCKET ASSEMBLY FOR ELECTRICAL PLUGS

BACKGROUND OF THE INVENTION

The present invention relates generally to a socket assembly used for electrical plugs. More particularly, the present invention relates to self-closing safety socket assembly uses a plate and a spring in cooperation to facilitate the insertion and the subsequent removal of an electrical plug into and out of a socket. The present invention is particularly suitable for connection with extension cords.

Safety sockets capable of self-closure are known. Two examples of these sockets are U.S. Pat. No. 2,820,842 to J. V. Meistrell and U.S. Pat. No. 4,600,258 to Hu. In '842, a shutter is provided in cooperation with a spring to close or block undesired objects from entering the socket. In '258, a partition board is provided in cooperation with a spring to close or block the entrance of the socket. For normal insertion of a plug through the slots, the shutter or the partition board has to be displaced sideways, i.e., by moving the shutter by the plug in Meistrell's patent or by externally pulling the partition board in Hu's patent. In either case, an external lateral force is required to allow insertion of the plug. A disadvantage resulting from the requirement of an external lateral force is that when the safety socket is used in connection with a portable power line or extension cord (i.e., the socket is not fixed), it will be difficult to insert the plug if one hand is unavailable to secure the socket while the other hand insert the plug.

To facilitate the insertion of a plug while still retaining a safety factor, the present invention discloses an improved socket assembly comprising a plate means which has one side wall for each of the plug's guiding slots tapered sideward or sideways. The side wall is tapered so that an insertion of the plug will move the plate means sideways. In this manner, an insertion of a plug into the socket assembly in accordance with the present invention is simple and direct, without the need to apply an additional lateral force prior to or the necessity to hold the socket stationary during this procedure.

SUMMARY OF THE INVENTION

Accordingly, it is an object of this invention to provide a safety socket assembly which facilitates insertion of a plug directly, even when the safety socket is not fixed or kept stationary.

A further object of this invention is to provide an improved socket assembly which comprises a sliding plate having a pair of guiding slots each substantially the same size as an ordinary hot slot, but with a side wall tapered outwardly and sidewardly, thereby the sliding plate can be forced to move sideways upon application of a longitudinal force on the tapered side wall as applied by an insertion of an electrical plug.

Another object of this invention is to provide an improved socket assembly of the type comprising a base and a cover fixedly mounted on the base; a plate means and a spring means being disposed between the base and the cover, the plate means being displaceable upon an insertion of a plug into the slots on the cover and being urged back to an original position by the spring means, the spring means being suitably retained in position on the cover, integrally formed with the sliding means, or suitably retained on an additional securing plate fixedly mounted between the base and the sliding means.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
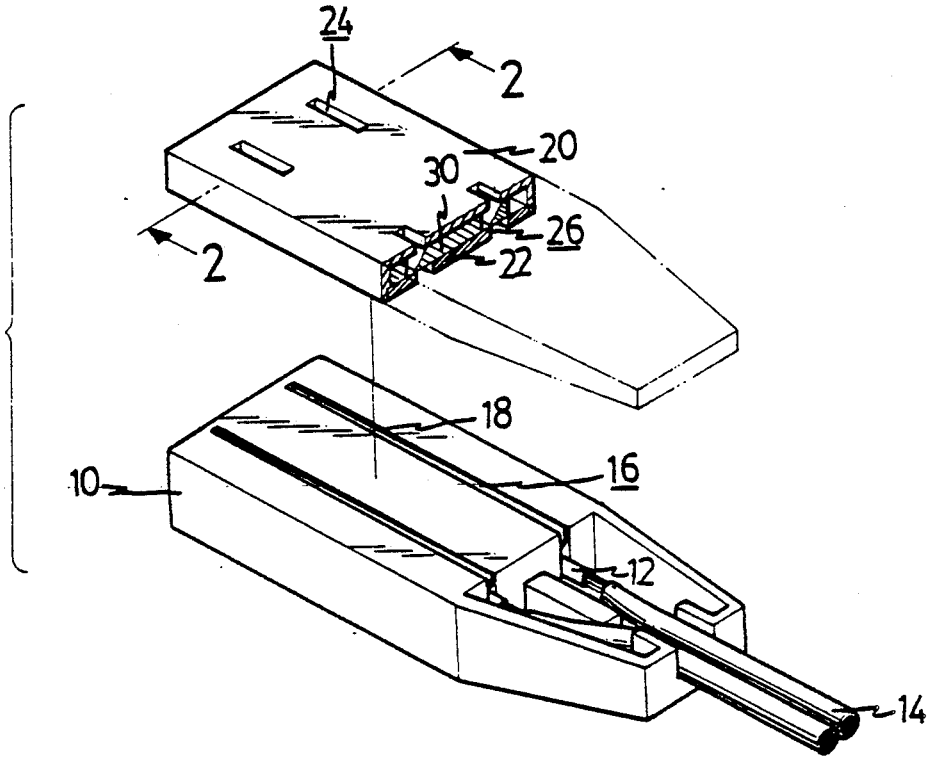
FIG. 1 is an exploded view showing a socket assembly in accordance with the present invention.
Figure 2:
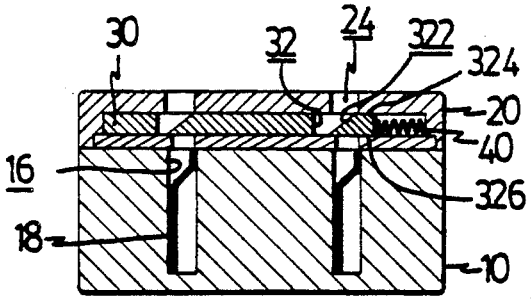
FIG. 2 is a cross-sectional view of an assembled socket assembly taken about on line 2—2 of FIG. 1, showing the plate means of the invention in a relaxed position.
Figure 3:
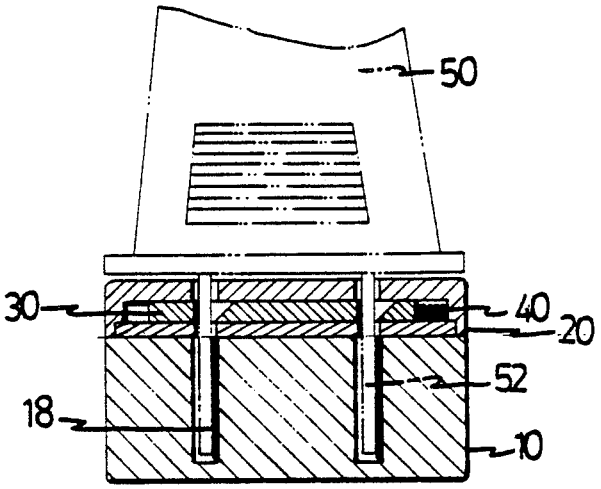
FIG. 3 is a view similar to FIG. 2 but showing the plate means being displaced upon an insertion of an ordinary plug.

Referring to the drawings, and more particularly to FIGS. 1 to 3, there is shown the socket assembly which incorporates the preferred embodiment of the present invention. The socket assembly comprises a base 10 and a cover 20 fixedly mounted to the base 10. The base 10 has necessary electrical elements, such as bus bars 12 connected to conducting leads 14 and a respective contact 18 connected to the bus bar 12 in order to construct a complete electrical connection upon the insertion of a plug. The base 10 is also shown to have a pair of channels 16 for receiving the prongs of an ordinary plug 50 (cf. FIG. 3) passing through the cover 20 and is otherwise designed in a known manner which will not be further described herein. The cover 20 is complementary in size and shape with the base 10 so that it can be directly affixed to the base 10 by gluing or any other means known in this art. The cover 20 has a box-like shape with an open bottom sealed by a securing plate 22, and has two pairs of hot slots 24 thereon. The bottom securing plate 22 also has similar hot slots 26 in alignment with the hot slots 24 of the cover 20. Between the cover 20 and the securing plate 22, there is provided a respective sliding plate 30 intended for performing a sliding movement on the securing plate 22 in response to an insertion of the electrical plug. It is noted that the securing plate 22 may be removed in the present embodiment, and the sliding plate 30 then rests directly on the base 10 and slidable relative thereto; however, the securing plate 22 will be useful in other cases and serves to facilitate the sliding movement of the sliding plate 30 in a desired manner.

FIGS. 2 and 3 are cross-sectional views of the socket assembly in assembled configuration, showing the sliding plate 30 of the invention in a relaxed position and in a displaced position in response to an insertion of a plug 50 (shown by dotted lines), respectively. The sliding plate 30 has a pair of guiding slots 32 thereon corresponding to the hot slots 24 of the cover 20. The guiding slots 32 each have a tapered side wall 322 starting from a bottom face 326 of the sliding plate 30 to a top face 324 thereof so that the width of the slot 32 is larger on the top than on the bottom. The angle of the side wall 322 relative to a general plane of the sliding plate 30 is so selected that, on the one hand, when the tapered side wall 322 opposes or aligns with the corresponding slot 24 of the cover 20, a projection of the side wall 322 substantially encompasses the slot 24 and, on the other hand, the hot slot 26 of the bottom securing plate 22, or the channel 16 on the base 10 (if the securing plate 22 is removed), is blocked or closed by the bottom face 326 of the sliding plate 30. Due to the provision of the tapered side wall 322, the prongs 52 of the plug 50 each, when contacting the side wall 322 from above, will force the sliding plate 30 to move laterally. This effect, i.e., a lateral movement of the sliding plate 30, is essentially the same as applying an external lateral force on the sliding plate 30 directly. A spring 40 is provided between each sliding plate 30 and an inner side wall of the cover 20 so that it is compressed when the plug 50 is inserted, and will urge the sliding plate 30 back to its original position, which blocks communication between the hot slots 24 of the cover 20 and the channel 16 of the base 10, as shown in FIG. 2.

Figure 4:
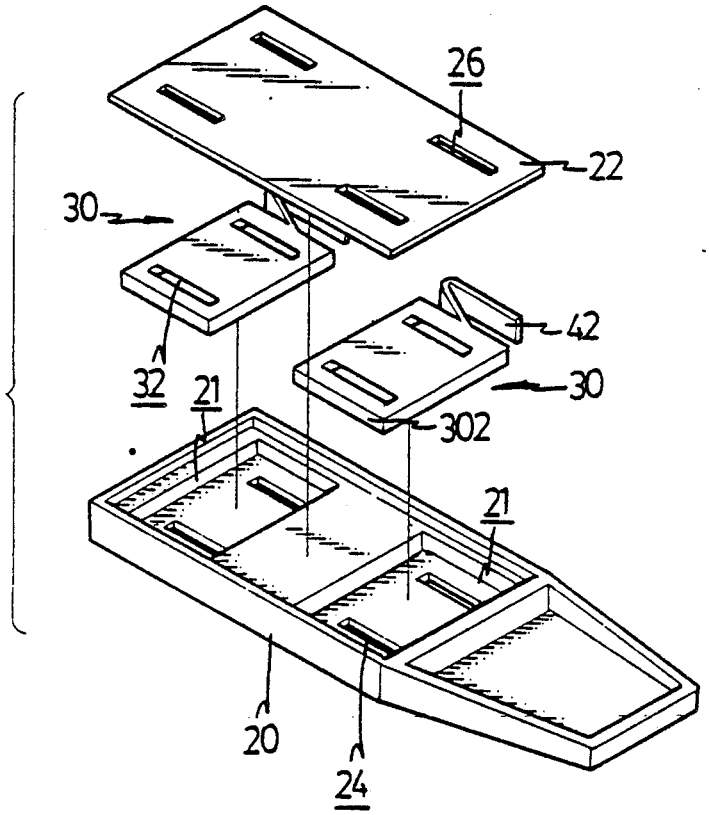
FIG. 4 is an exploded view particularly showing the relationship between the cover, the plate means and the spring means in accordance with a further embodiment of the invention.

FIG. 4 shows that the spring 40 seen in FIGS. 2 and 3 can be replaced by a resilient strip 42 integrally formed on one end of the sliding plate 30. It can also be seen that the cover 20 has a respective chamber 21 of a complementary width to that of the sliding plate 30 so that the sliding plate 30 is slidable under the guidance of the cover 20. It is noted that another opposite end of the sliding plate 30 is in contact with a side wall of the chamber 21 when the sliding plate 30 is in a relaxed position as shown in FIG. 2.

Figure 5:
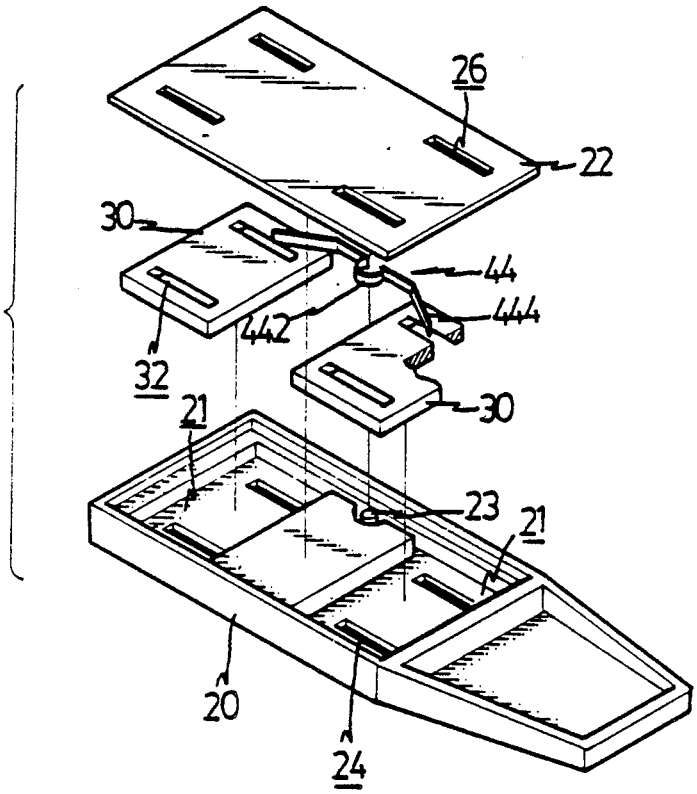
FIG. 5 is a view similar to FIG. 4 but showing the relationship between the cover, the plate means and the spring means in accordance with yet a further embodiment of the invention.

FIG. 5 shows that above-mentioned springs for retaining and restoring the sliding in a proper relaxed position can be further replaced by a plate spring 44 secured to a pin 23 of the cover 20 at a center 442 thereof. The plate spring 44 has two opposite ends 444 bearing against a respective sliding plate 30. In this and subsequent embodiments, constructions and operations will be assumed similar or identical to the above unless otherwise specified.

Figure 6:
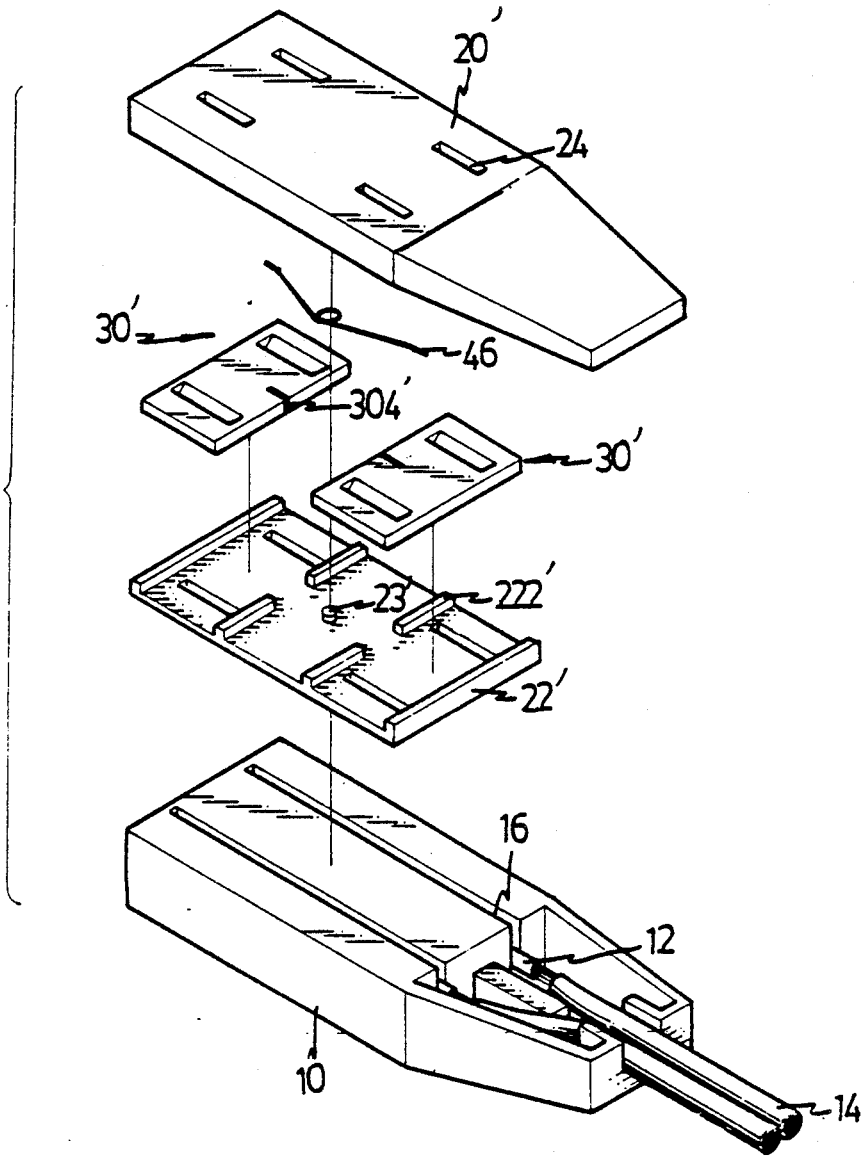
FIG. 6 is an exploded view particularly showing the relationship between a securing plate, the plate means and the spring means in accordance with yet another embodiment of the invention.

FIG. 6 shows particularly a modified securing plate 22' and a modified sliding plate 30' in combination with a wire spring 46 in accordance with yet another embodiment of the invention. The wire spring 46 is secured to a pin 23' of the bottom securing plate 22' at an approximate center thereof instead of a sidewardly attachment to the pin 23 of the cover 20. The wire spring 46 has two opposite ends for engaging into an intermediate notch 304' of each sliding plate 30'. The bottom securing plate 22' is spaced or partitioned by several protrusions 222' to accommodate and guide the sliding plate 30'. Unlike the covers in FIGS. 4 and 5, the construction of the cover 20' of the present embodiment can be simplified to have a substantially flat inner face.

Figure 7:
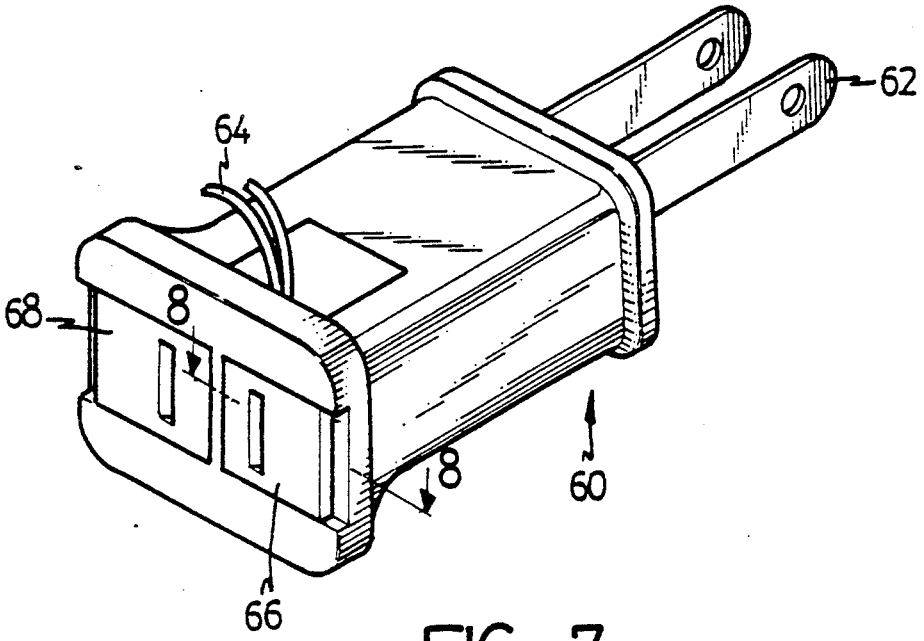
FIG. 7 is a perspective view showing another type of socket assembly which employs the plate means and the spring means of the invention.
Figure 8A:
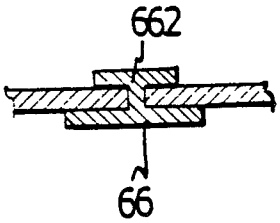
FIG. 8A is a detailed cut-away sectional view showing an example of the retention of the plate means on the socket assembly.
Figure 8:
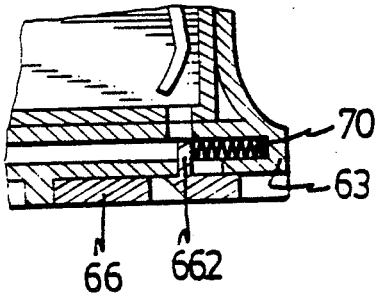
FIG. 8 is a cut-away cross-sectional view taken about on line 8—8 of FIG. 7, showing the plate means in a relaxed position.

As mentioned above, the present invention finds its particular use in extension cords or as an extension cord socket. FIG. 7 illustrates such a socket assembly which has built-in prongs 62 and connection lines 64. Unlike previous embodiments, the socket assembly 60 has separate sliding plates 66 and 68 for each single prong of an external plug (not shown). That is, the two sliding plates 66 and 68 will be displaced separately and independently. Also, since the sliding plates 66 and 68 are disposed outside, they are provided with an integral leg 662 to cooperate with the spring 70 within the cover frame 63, as seen in FIG. 8, in a manner that the sliding plates 66 and 68 can be slidably retained on the socket assembly 60, as shown in FIG. 8A.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as shall fall within the scope of the appended claims.

I claim:

1. A socket assembly for electrical plugs comprising:

(a) a base member for carrying electrical elements required to establish a complete electrical connection upon the insertion of an electrical plug;

(b) a cover member mounted on the base member and provided with two pairs of hot slots therethrough, each pair of hot slots for insertion of an electrical plug;

(c) a securing plate secured to a bottom of the cover member to define a pair of chamber areas therewith, each chamber area corresponding to a respective pair of hot slots of the cover member, the securing plate being provided with a prior member and two pairs of hot slots therethrough corresponding to and aligned with the two pairs of hot slots of the cover member;

(d) a sliding plate disposed within each chamber area, each sliding plate being provided with an intermediate notch and a pair of guiding slots therethrough, each guiding slot including a tapered side face, the side faces of each pair of guiding slots being normally positioned opposite a pair of hot slots being in the cover member to block communication between corresponding pairs of hot slots in the base and cover members, the sliding plates being slidably displaceable upon the insertion of an electrical plug through a pair of hot slots in the cover member and forced engagement of the plug against the tapered side faces of the sliding plate; and (e) a spring centrally disposed intermediate the chamber areas for biasing and maintaining the side faces of the sliding plates in the normal positions, the spring including a central portion retained on the pin member of the securing plate and two opposite ends, each opposite end being engaged within the intermediate notch of a sliding plate.

2. The socket assembly of claim 1 wherein the spring is a wire spring.

3. The socket assembly of claim 1 wherein the securing plate further includes a plurality of protrusions for guiding the sliding plates.

* * * * *